US011183776B2

(12) United States Patent
Lin

(10) Patent No.: US 11,183,776 B2
(45) Date of Patent: Nov. 23, 2021

(54) OUTPUT WIRE JOINING STRUCTURE OF WINDING SEAT FOR TRANSFORMER OR INDUCTOR

(71) Applicant: CHYNG HONG ELECTRONIC CO., LTD., Taichung (TW)

(72) Inventor: Mu-Chun Lin, Taichung (TW)

(73) Assignee: CHYNG HONG ELECTRONIC CO., LTD., Taichung (TW)

( * ) Notice: Subject to any disclaimer, the term of this patent is extended or adjusted under 35 U.S.C. 154(b) by 489 days.

(21) Appl. No.: 16/369,112

(22) Filed: Mar. 29, 2019

(65) Prior Publication Data

US 2020/0313311 A1 Oct. 1, 2020

(51) Int. Cl.

| | |
|---|---|
| ***H01F 27/30*** | (2006.01) |
| ***H01R 4/02*** | (2006.01) |
| ***H01F 27/06*** | (2006.01) |
| ***H01F 27/29*** | (2006.01) |
| ***H01F 27/28*** | (2006.01) |

(52) U.S. Cl.
CPC ..... *H01R 4/027* (2013.01); *H01F 27/06* (2013.01); *H01F 27/2823* (2013.01); *H01F 27/29* (2013.01); *H01R 4/023* (2013.01)

(58) Field of Classification Search
USPC ..... 336/192, 196, 198, 208
See application file for complete search history.

(56) References Cited

U.S. PATENT DOCUMENTS 4,549,158 A * 10/1985 Mitsui ..... H01F 5/02 336/192
6,175,295 B1 * 1/2001 Honma ..... H01F 5/02 336/192
6,344,786 B1 * 2/2002 Chin ..... H01F 27/06 336/192
6,559,479 B1 * 5/2003 Ludemann ..... H01L 27/142 136/255
7,061,358 B1 * 6/2006 Yang ..... H01F 17/043 336/198
9,105,392 B2 * 8/2015 Yang ..... H01F 27/2866
9,293,246 B1 * 3/2016 Folker ..... H01F 27/06
2002/0070833 A1 * 6/2002 Junjie ..... H01F 27/325 336/198
2012/0223799 A1 * 9/2012 Hester ..... H01F 27/30 336/220
2015/0116068 A1 * 4/2015 Kwon ..... H01F 27/2828 336/192
2015/0137928 A1 * 5/2015 Wakibayashi ..... H01F 27/292 336/192
2015/0302978 A1 * 10/2015 Yang ..... H01F 27/2823 336/208

* cited by examiner

*Primary Examiner* — Ronald Hinson
(74) *Attorney, Agent, or Firm* — Sinorica, LLC

(57) ABSTRACT

An output wire joining structure of a winding seat for a transformer or an inductor is disclosed. The winding seat includes a winding portion and a support portion. The winding portion is disposed on top of the support portion for winding a coil. Two sides of the support portion are provided with pin holders for insertion of output wires of the coil. At least one joining plate is disposed beneath the pin holders corresponding in position to the output wires. The output wires of the coil and metal pins of the pin holders are soldered to the joining plate respectively, so that the output wires and the metal pins are quickly soldered and fixed to form a connection, which has the advantages of increasing the rated current and facilitating the operation.

3 Claims, 5 Drawing Sheets

OUTPUT WIRE JOINING STRUCTURE OF WINDING SEAT FOR TRANSFORMER OR INDUCTOR

FIELD OF THE INVENTION

The present invention relates to a transformer or an inductor, and more particularly to an output wire joining structure of a winding seat for a transformer or an inductor.

BACKGROUND OF THE INVENTION

A transformer often plays an important role for converting power or isolating signals in various electronic components. An inductor is one of passive electronic components, which is often used in electronic products. It resists current changes in the electronic circuit, thereby filtering current noise, stabilizing the current value in the circuit, reducing electromagnetic interference and converting power.

Generally, the winding structure of the transformer or the inductor includes a winding frame, a coil unit, and a magnetic core unit. (The coil unit of the transformer may include a primary coil and a secondary coil.) The coil unit is wound around the winding frame. The magnetic core unit is mounted on the winding frame wound with the coil unit, and is partially inserted into the passage of the winding frame, thereby completing the assembly of the transformer or the inductor. However, the coil unit of the assembled transformer or inductor is composed of several wires. In order to short-circuit the output ends of the wires, it is often necessary to wind the output or input ends around metal pins of the winding frame through metal wires. The outlet ends are connected to the metal pins by soldering. The metal wires are wound manually, which requires certain skills and rules, so it is difficult to control the quality. After soldering, it is easy to cause uneven soldering at the soldering joints. This not only affects the appearance, but also causes defects such as incomplete soldering and high impedance. Accordingly, the inventor of the present invention has devoted himself based on his many years of practical experiences to solve these problems.

SUMMARY OF THE INVENTION

The primary object of the present invention is to provide an output wire joining structure of a winding seat for a transformer or an inductor, which can ensure uniform soldering and beautiful appearance. The impedance is low and the rated current is large enough, so that the transformer or the inductor is not easy to be burned. The service life is prolonged, the processing is easy, the labor cost is reduced, and the production is convenient.

In order to achieve the aforesaid object, an output wire joining structure of a winding seat for a transformer or an inductor is provided. The winding seat comprises a winding portion and a support portion. The winding portion is disposed on top of the support portion for winding a coil. Two sides of the support portion are provided with pin holders. Each of the pin holders is provided with a plurality of spaced positioning protrusions and accommodating grooves each defined between every adjacent two of the positioning protrusions for insertion of output wires of the coil, a metal pin being disposed beneath each of the positioning protrusions. At least one joining plate is disposed beneath the pin holders corresponding in position to the output wires. The joining plate is an elongated plate made of a metal material. The joining plate has a plurality of positioning tabs corresponding to the positioning protrusions of the pin holders and a plurality of receiving grooves corresponding to the accommodating grooves of the pin holders. Each of the receiving grooves is defined between every adjacent two of the positioning tabs. The receiving grooves each have an opening, and the accommodating grooves each have an opening. The openings of the receiving grooves and the openings of the accommodating grooves are located at a same side. Each of the positioning tabs has a perforation for the metal pin to pass through.

Through the output wire joining structure of the winding seat for a transformer or an inductor provided by the present invention, the joining plates are attached to the pin holders, and then the output wires are pulled along the accommodating grooves of the pin holders and the receiving grooves of the joining plates. The output wires are soldered to the metal pins of the corresponding joining plates, so that the output wires and the metal pins are fixedly connected to the joining plates, respectively. Thus, the output wires and the metal pins can be quickly soldered and fixed to form a connection, without complicated winding.

DETAILED DESCRIPTION OF THE PREFERRED EMBODIMENTS

Embodiments of the present invention will now be described, by way of example only, with reference to the accompanying drawings.

Figure 1:
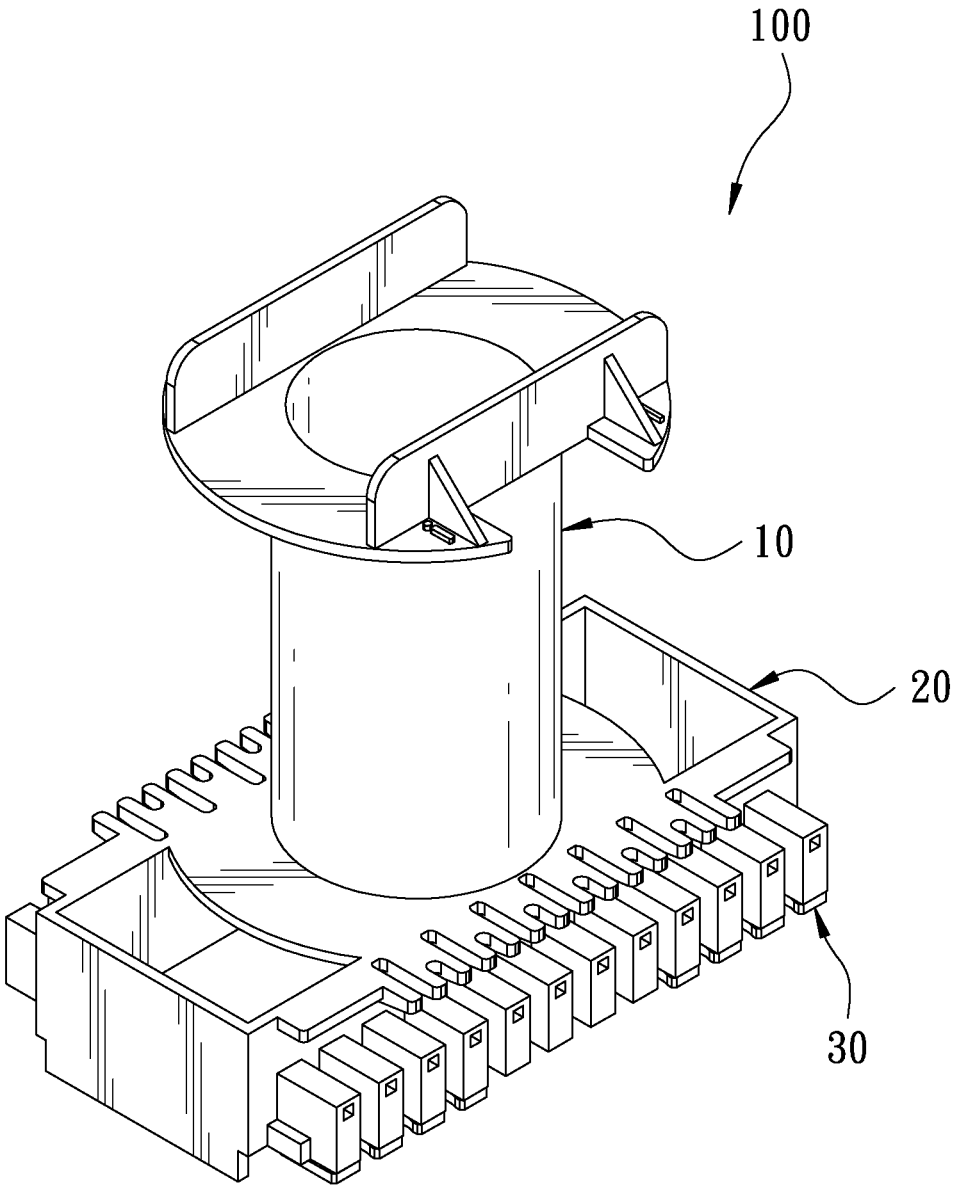
FIG. 1 is a perspective view in accordance with a preferred embodiment of the present invention.
Figure 2:
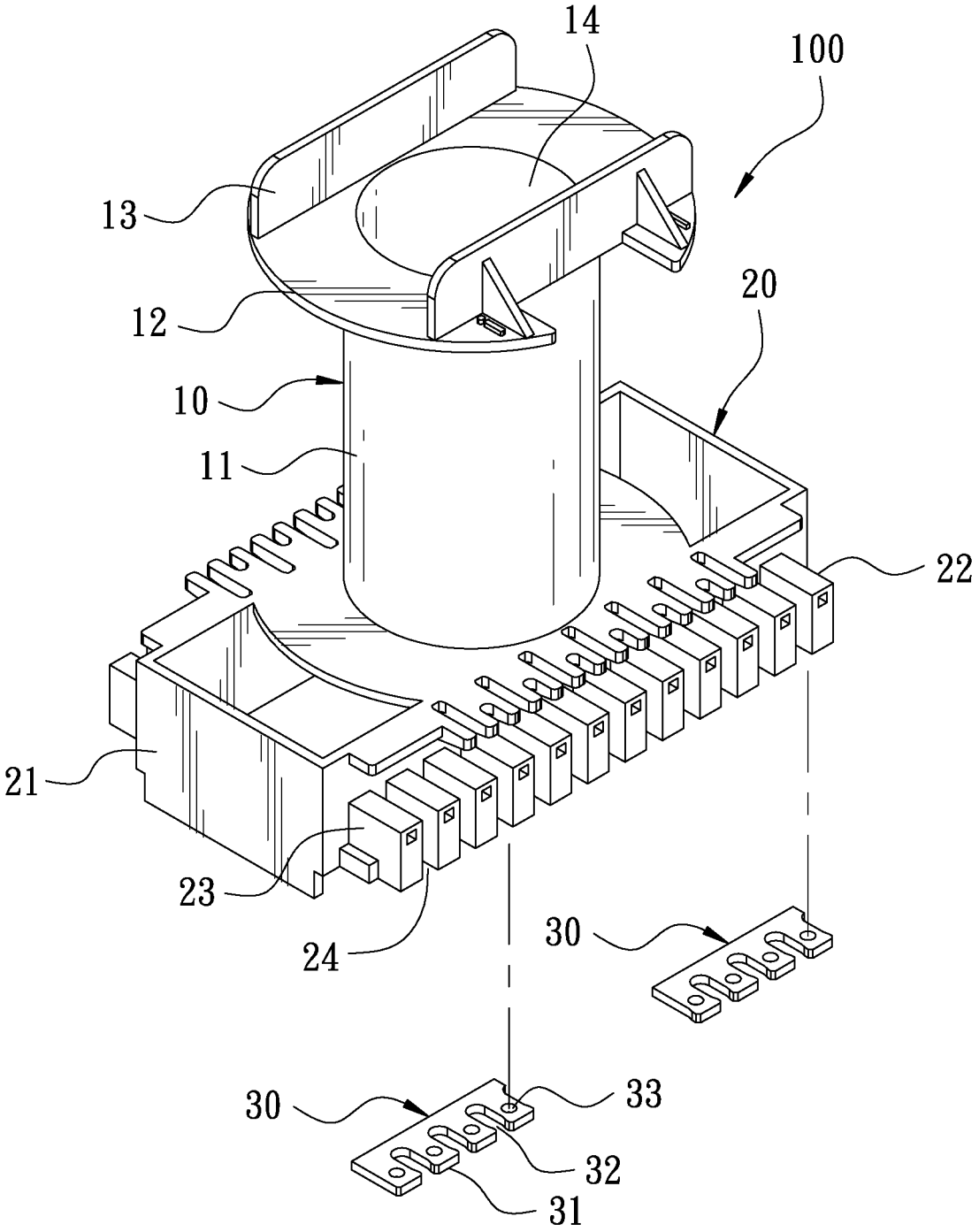
FIG. 2 is a partial perspective view in accordance with the preferred embodiment of the present invention.
Figure 3:
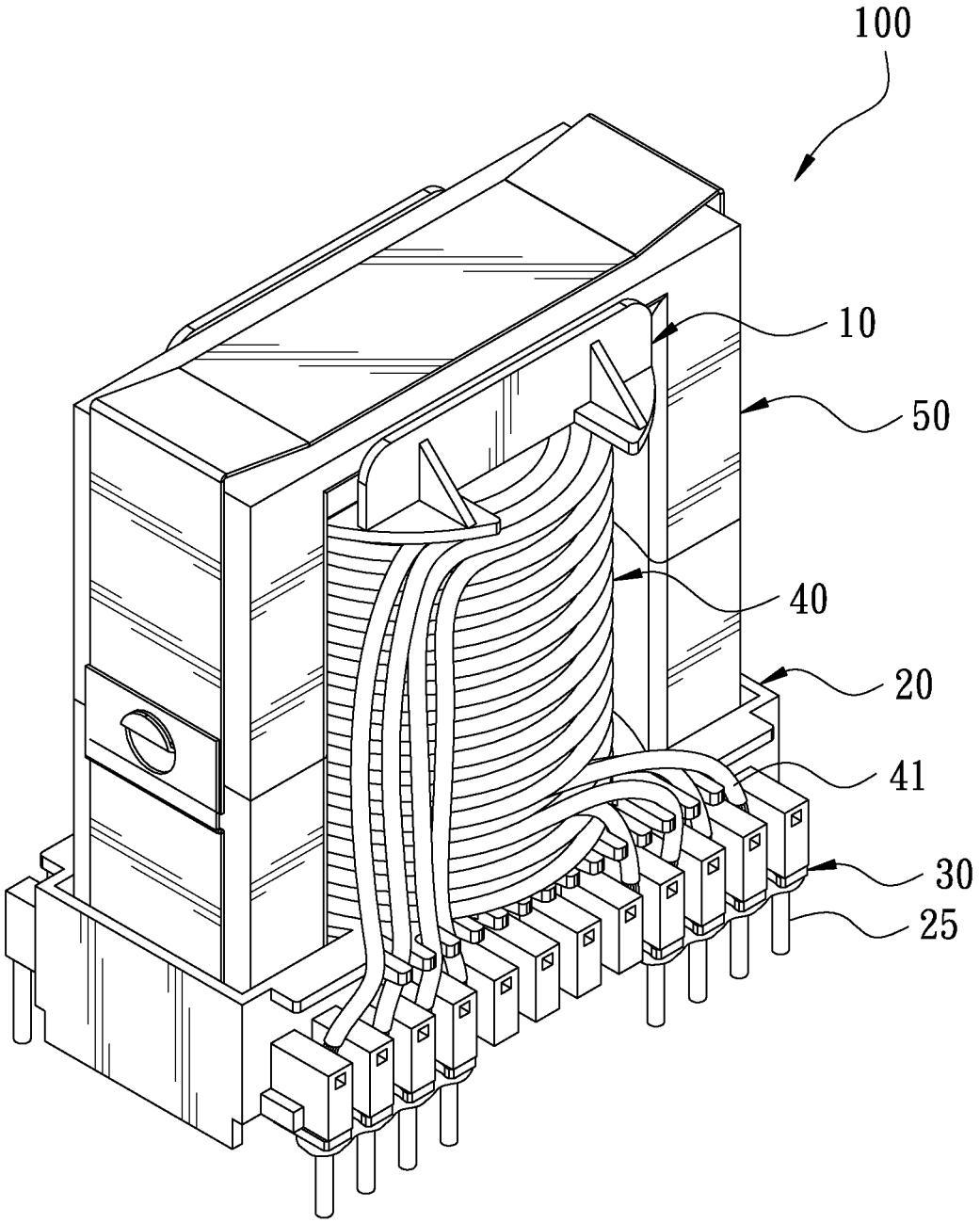
FIG. 3 is a schematic view in accordance with the preferred embodiment of the present invention after assembly.

FIG. 1 is a perspective view in accordance with a preferred embodiment of the present invention. FIG. 2 is a partial perspective view in accordance with the preferred embodiment of the present invention. FIG. 3 is a schematic view in accordance with the preferred embodiment of the present invention after assembly. The present invention discloses an output wire joining structure of a winding seat for a transformer or an inductor. The winding seat 100 comprises a winding portion 10 and a support portion 20.

The winding portion 10 is made of an insulating material. The winding portion 10 includes a winding area 11 and a top plate 12. The winding portion 11 is configured to wind a coil 40. The coil 40 is provided with a plurality of output wires 41. The top plate 12 is disposed on top of the winding portion 10. Tow side of the top plate 12 are provided with stoppers 13. The winding portion 10 is provided with a through hole 14 passing through the top plate 12.

The support portion 20 is disposed beneath the winding portion 10. The periphery of the support portion 20 is provided with a plurality of baffles 21 having an appropriate height. The baffles 21 are collectively formed into a rectangle. Two sides of the support portion 20 are provided with pin holders 22. Each pin holder 22 is provided with a plurality of spaced positioning protrusions 23 and accommodating grooves 24 each defined between every adjacent two of the positioning protrusions 23 for insertion of the output wires 41. A metal pin 25 is disposed beneath each of the positioning protrusions 23. Two joining plates 30 are disposed beneath the pin holders 22 corresponding in position to the output wires 41. The joining plates 30 each have a plurality of positioning tabs 31 corresponding to the positioning protrusions 23 of the pin holders 22 and a plurality of receiving grooves 24 corresponding to the accommodating grooves 24 of the pin holders 22. Each of the receiving grooves 24 is defined between every adjacent two of the positioning tabs 31 and has a U shape. The receiving grooves 32 each have an opening, and the accommodating grooves 24 each have an opening. The openings of the receiving grooves 32 and the openings of the accommodating grooves 24 are located at the same side. Each of the positioning tabs 31 has a perforation 33 for the metal pin 25 to pass through.

Figure 4:
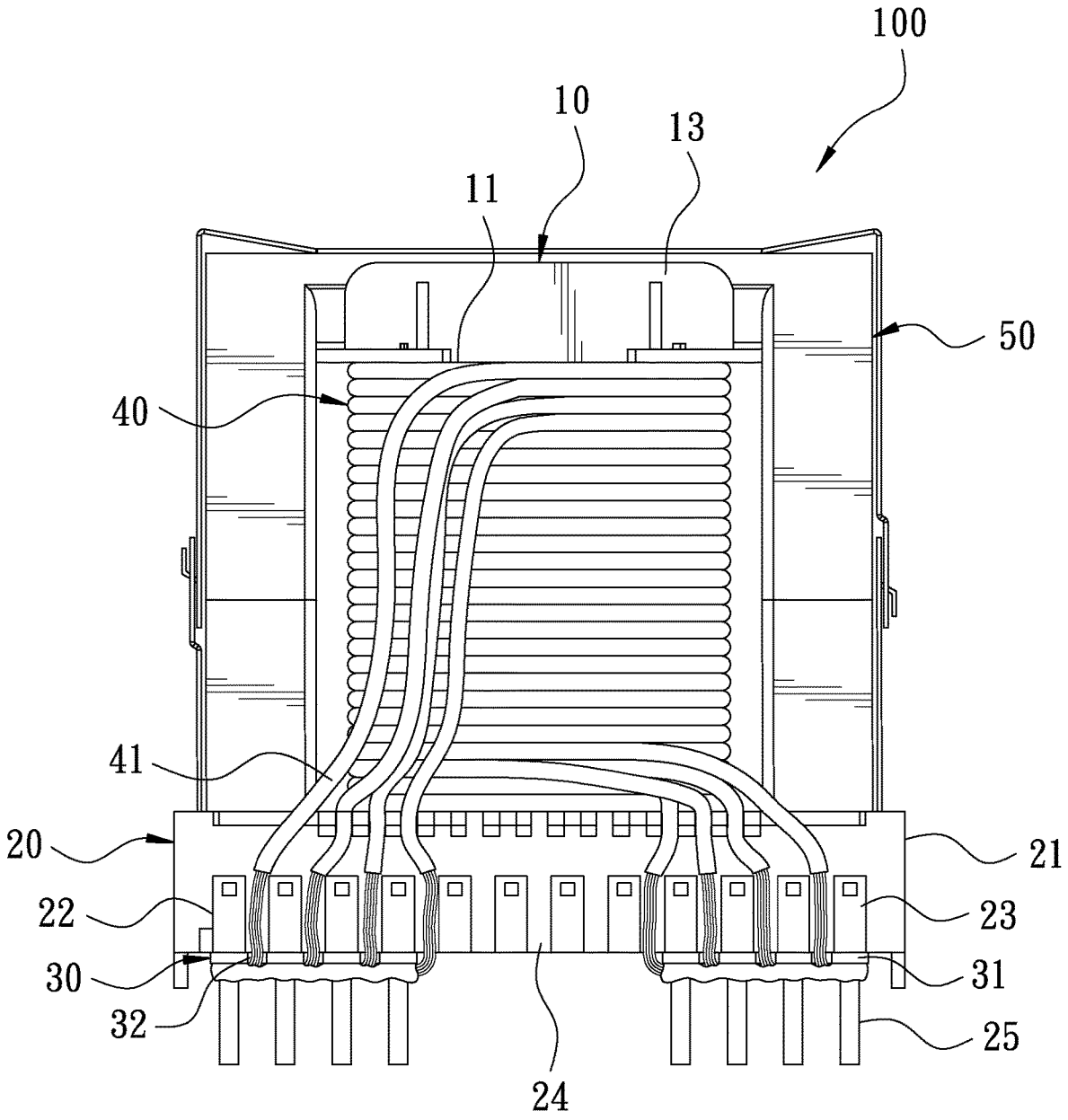
FIG. 4 is a side view in accordance with the preferred embodiment of the present invention after assembly.
Figure 5:
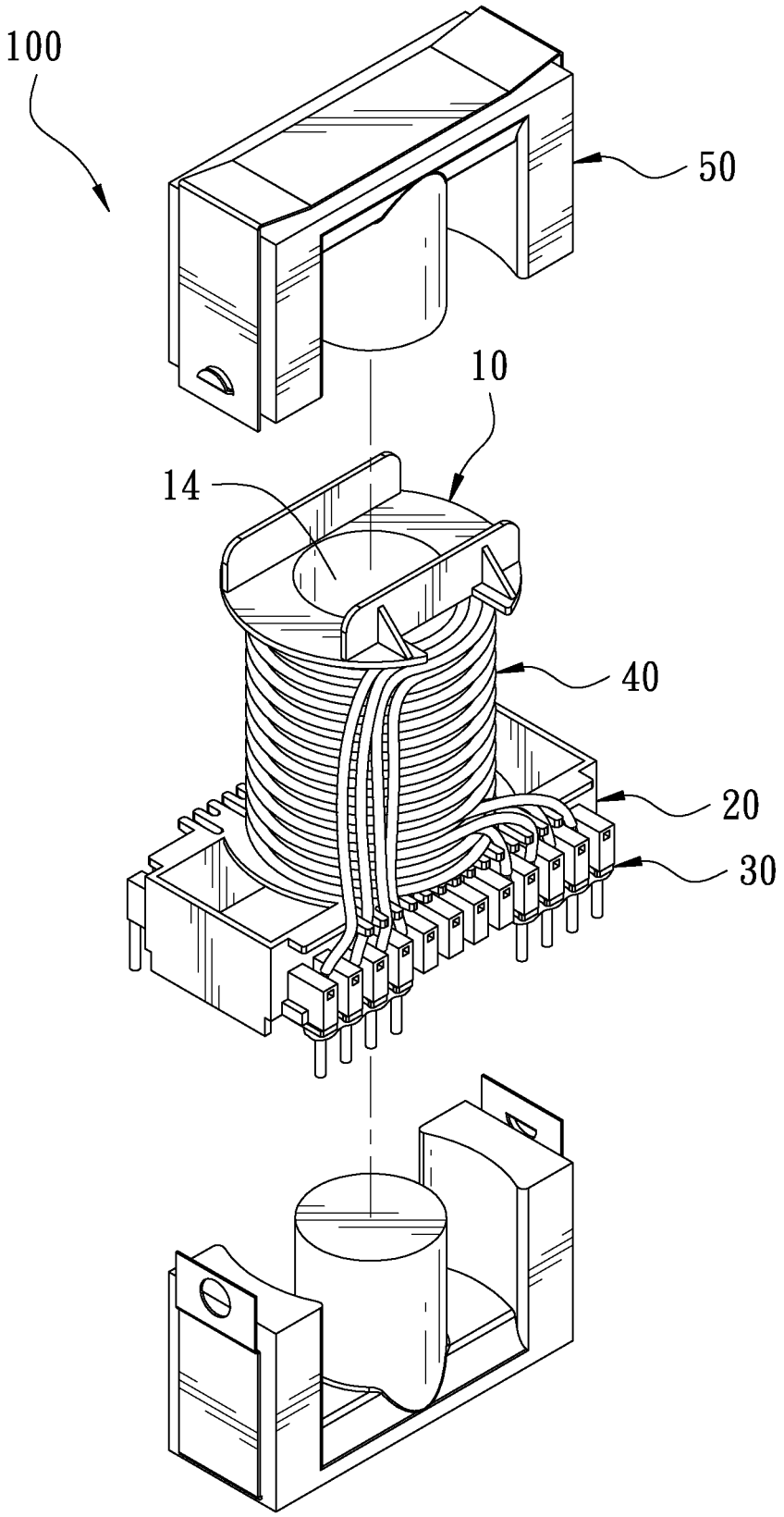
FIG. 5 is an exploded view in accordance with the preferred embodiment of the present invention.

FIG. 4 is a side view in accordance with the preferred embodiment of the present invention after assembly. FIG. 5 is an exploded view in accordance with the preferred embodiment of the present invention. The electronic component assembled in this embodiment is an inductor. The coil 40 is wound around the winding area 11. The output wires 41 are pulled along the accommodating grooves 24 and the receiving grooves 32 to the pin holders 22, and the output wires 41 are soldered to the corresponding joining plates 30 and the metal pins 25, respectively. The output wires 41 and the metal pins 25 are fixedly connected to the joining plates 30, respectively. After the coil 40 is wound, a pair of iron cores units 50 are inserted into the through hole 14 from the top surface and the bottom surface of the winding portion 10, respectively. The positioning of the iron core units 50 can be achieved by the stoppers 13 and the baffles 21, respectively. Because the top surface and the bottom surface of the winding portion 10 are formed in a groove shape through the stoppers 13 and the baffles 21, the iron core units 50 can be pressed against the winding portion 10 after being assembled. The outside of the winding portion 10 can be reinforced and fixed by insulating copper sheets, thereby completing the assembly of the inductor.

FIG. 4 is a side view in accordance with the preferred embodiment of the present invention after assembly. The joining plates 30 are elongated plates made of a metal material. The positioning tabs 31 and the receiving grooves 32 are similar in shape to the positioning protrusions 23 and the accommodating grooves 24, so that the joining plates 30 can be completely attached to the pin holders 22. Thus, the joining plates 30 can replace the metal wires used in the conventional winding circuit plate, without complicated winding. The output wires 41 and the metal pins 25 can be simultaneously fixedly connected to the joining plates 30 to form a connection. The number of the positioning tabs 31 of the joining plates 30 is not limited to that shown in FIG. 4, and can be set according to the number of the output wires 41. It is faster and more convenient for use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An output wire joining structure of a winding seat for a transformer or an inductor, the winding seat comprising a winding portion and a support portion, the winding portion being disposed on top of the support portion for winding a coil, two sides of the support portion being provided with pin holders, each of the pin holders being provided with a plurality of spaced positioning protrusions and accommodating grooves each defined between every adjacent two of the positioning protrusions for insertion of output wires of the coil, a metal pin being disposed beneath each of the positioning protrusions, characterized by:

at least one joining plate, disposed beneath the pin holders corresponding in position to the output wires, the joining plate being an elongated plate made of a metal material, the joining plate having a plurality of positioning tabs corresponding to the positioning protrusions of the pin holders and a plurality of receiving grooves corresponding to the accommodating grooves of the pin holders, each of the receiving grooves being defined between every adjacent two of the positioning tabs, the receiving grooves each having an opening, the accommodating grooves each having an opening, the openings of the receiving grooves and the openings of the accommodating grooves being located at a same side, each of the positioning tabs having a perforation for the metal pin to pass through.

2. The output wire joining structure of the winding seat as claimed in claim 1, wherein each of the receiving grooves of the joining plate has a U shape.

3. The output wire joining structure of the winding seat as claimed in claim 1, wherein the openings of the receiving grooves and the openings of the accommodating grooves face outward.

* * * * *